US007165953B2

(12) United States Patent
Reynders et al.

(10) Patent No.: US 7,165,953 B2
(45) Date of Patent: Jan. 23, 2007

(54) DEVICE FOR CONVEYING A LIQUID

(75) Inventors: Luc Reynders, Riemst (BE); Bert Kempeneers, Bilzen (BE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/195,606

(22) Filed: Aug. 3, 2005

(65) Prior Publication Data

US 2006/0039810 A1 Feb. 23, 2006

Related U.S. Application Data

(63) Continuation of application No. PCT/EP2004/050121, filed on Feb. 12, 2004.

(30) Foreign Application Priority Data

Feb. 12, 2003 (DE) ..... 103 05 962

(51) Int. Cl.
*F04B 17/00* (2006.01)

(52) U.S. Cl. ..... 417/424.1; 417/423.3

(58) Field of Classification Search ..... 417/424.1, 417/423.3, 199.2, 200, 201, 202, 87, 89
See application file for complete search history.

(56) References Cited

U.S. PATENT DOCUMENTS 2,391,769 A * 12/1945 Campbell ..... 415/11

FOREIGN PATENT DOCUMENTS

| | | |
|---|---|---|
| DE | 44 32 224 | 3/1996 |
| GB | 1 307 170 | 2/1973 |
| JP | 01 032095 | 2/1989 |
| JP | 08 144989 | 6/1996 |

* cited by examiner

*Primary Examiner*—Anthony Stashick
*Assistant Examiner*—Vikansha Dwivedi
(74) *Attorney, Agent, or Firm*—Crowell & Moring LLP

(57) ABSTRACT

A device for conveying a liquid, in particular a cutting liquid from a machining operation containing production residues. The device includes a vertical pump having a pump housing (14), a pump impeller (13), a drive shaft (19) surrounded by a housing (18), an electric motor, and a shaft connection between the electric motor and the pump impeller (13). The pump housing (14) has an inlet opening (15) and a liquid delivery opening (16). When the pump is started, a negative pressure is generated in the housing (18) surrounding the drive shaft (19). The zone of negative pressure extends into the pump housing (14) through a gap (22) between the shaft (19) and the housing (18) and thus assures that fluid will be drawn into the pump even when the liquid level is extremely low.

9 Claims, 2 Drawing Sheets

DEVICE FOR CONVEYING A LIQUID

CROSS REFERENCE TO RELATED APPLICATIONS

This application is a continuation of international patent application no. PCT/EP2004/050121, filed Feb. 12, 2004, designating the United States of America, and published in German on Aug. 26, 2004 as WO 2004/072484, the entire disclosure of which is incorporated herein by reference. Priority is claimed based on Federal Republic of Germany patent application no. DE 103 05 962.8, filed Feb. 12, 2003.

BACKGROUND OF THE INVENTION

The present invention relates to a device for transporting or conveying a liquid.

A device of this type is disclosed in published Japanese patent application no. JP 8-144989, comprising a pump that is driven by an electric motor. The pump is provided with an intake opening into which the liquid to be transported flows. The liquid is conveyed by the pump through a pipeline system. In these pumps the liquid level must not fall below the level of the impeller. If the liquid is present at a very low level which does not reach the level of the impeller, it is not possible to pump the liquid. To draw off this liquid, specialized methods must be used which are somewhat complicated. In addition, such pumps entail the risk of the pump bearing, i.e., the bearing for the drive shaft, running dry and possibly sustaining damage.

SUMMARY OF THE INVENTION

It is an object of the present invention to provide an improved device for conveying a liquid.

Another object is to provide a device for conveying a liquid which can function even if the liquid is present at a very low level.

A further object of the invention is to provide a device for conveying a liquid with a reduced risk of pump bearing damage.

It is also an object of the invention to provide a device for conveying a liquid which operates dependably and which reliably transports liquids that are present at a very low level.

An additional object is to provide a device for conveying a liquid which is particularly suitable for conveying a cooling lubricant liquid containing production residues.

These and other objects are achieved in accordance with the present invention by providing a device for conveying a liquid, the device comprising a vertical pump comprising a pump housing with an inlet opening and a liquid discharge opening, a pump impeller rotatably mounted in the pump housing, an electric motor for driving the pump impeller, and a drive shaft connected between the motor and the pump impeller, wherein the drive shaft is enclosed by a shaft housing, and above the pump impeller at least one gap in the shaft housing is provided for the drive shaft, and wherein, at least at the start of pumping, a negative pressure is generated in the shaft housing, the negative pressure extending through the gap into the pump housing to draw liquid through the inlet opening into the pump housing.

In accordance with the present invention, at least at the start of pumping, a negative pressure is present in the housing enclosing the drive shaft, the negative pressure continuing through the bearing system into the pump housing. The advantage of this arrangement is that the negative pressure causes the liquid at a low level to flow into the pump housing and fill this space until the liquid reaches a certain level that is sufficient to achieve transport.

In one advantageous embodiment of the invention, the liquid discharge opening is connected to a discharge pipe. The discharge opening, i.e., the pipe, is connected to a non-return valve or check valve so that the negative pressure in the pump housing can be maintained when the pump is in the start-up phase. The non-return valve may, for example, comprise a ball which is situated in the liquid pipe in a region of expanded cross section.

In another advantageous embodiment of the invention, a connector which is connected to a source of negative pressure is provided in the housing which encloses the drive shaft. The source of negative pressure may be a vacuum pump.

In accordance with a further advantageous design, the negative pressure is generated by an ejector, making use of the positive pressure from purified cooling lubricant liquid which is supplied to the ejector. Of course, it is also possible to use other types of liquids, or fluids such as air, for generating a negative pressure. If coolant lubricant liquid is used for generating negative pressure, it may be re-introduced directly into the liquid to be transported. It is therefore not necessary to prepare an additional auxiliary material.

It is advantageous for the negative pressure to be in the range from 0.05 bar to 0.3 bar. The required pressure is based solely on the height to be overcome between the intake opening and the pump impeller. The pump is preferably located in a container in which it is secured by a flange connection. The electric motor is likewise connected to the housing enclosing the drive shaft via a connecting flange.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
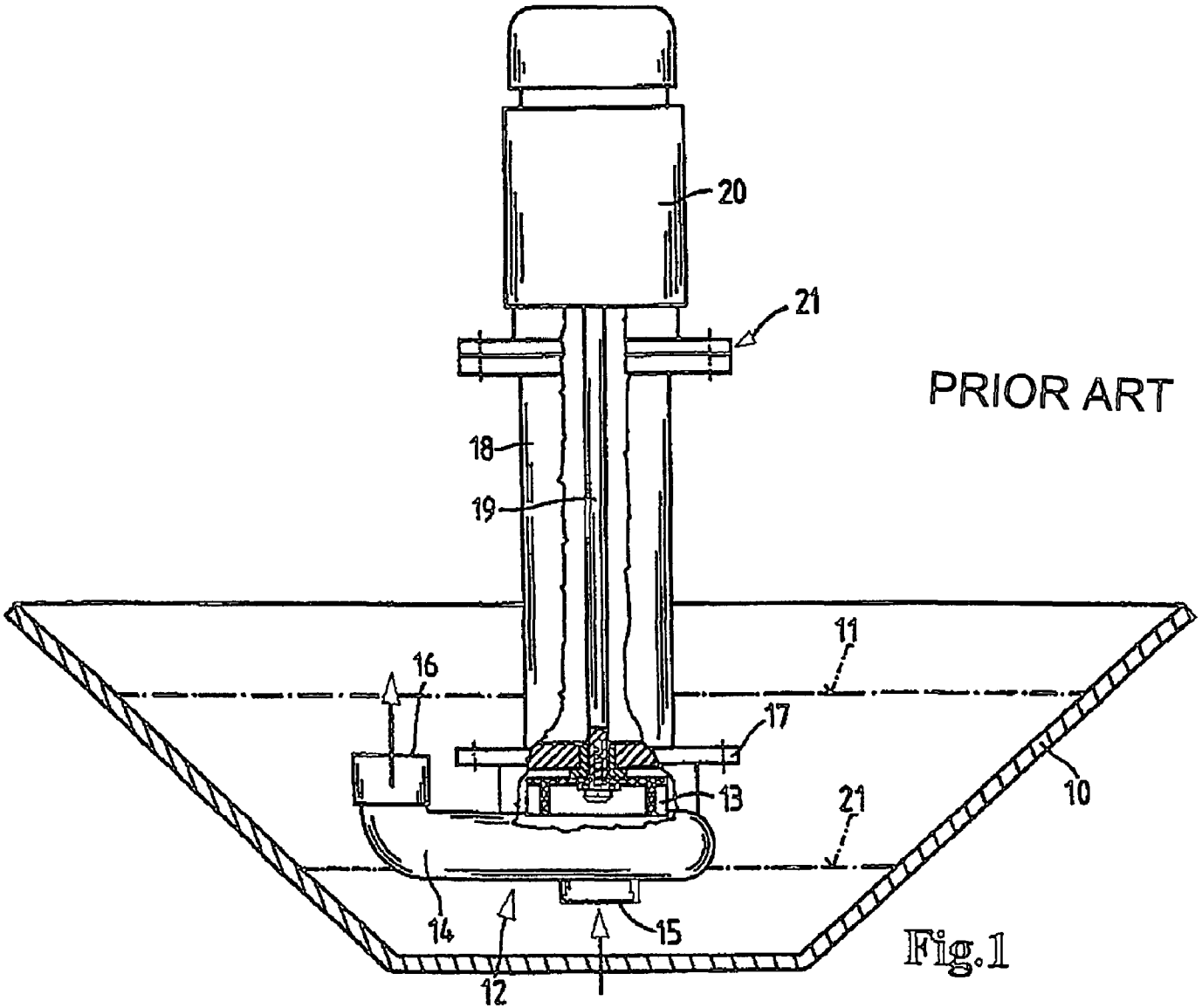
FIG. 1 is a representation of a known device for conveying a liquid such as a coolant/lubricant liquid.

According to FIG. 1, a container 10 is provided in which liquid is present up to the height of the level 11. A pump 12 comprising a pump impeller 13 and a pump housing 14 is provided inside the container 10. The pump 12 draws in the liquid through the intake opening 15 and transports the liquid to a liquid discharge opening 16 which typically is connected to a pipe or hose, not illustrated here. The pump 12 is provided with a mounting flange 17 which may be mounted on a fastening structure, not illustrated here, for the container.

A housing 18 in which the drive shaft 19 is situated extends above the pump 12. This drive shaft 19 is connected to an electric motor 20. The electric motor 20 is attached to the housing 18 via a flange connection 21. When the liquid in the container 10 is present at the illustrated level 11, liquid also flows in around the pump impeller 13. Consequently, when the electric motor 20 is started, the liquid is pumped from the container 10.

If the liquid is present at a level 21 that is below the pump impeller 13, and the pump 12 is started, there is no possibility of conveying the liquid, since the liquid cannot be drawn in. It is therefore desirable to position the entire system as deeply as possible in the container. However, a certain distance from the bottom of the container must be maintained at all times so that sufficient liquid is able to-flow into the intake opening 15.

Figure 2:
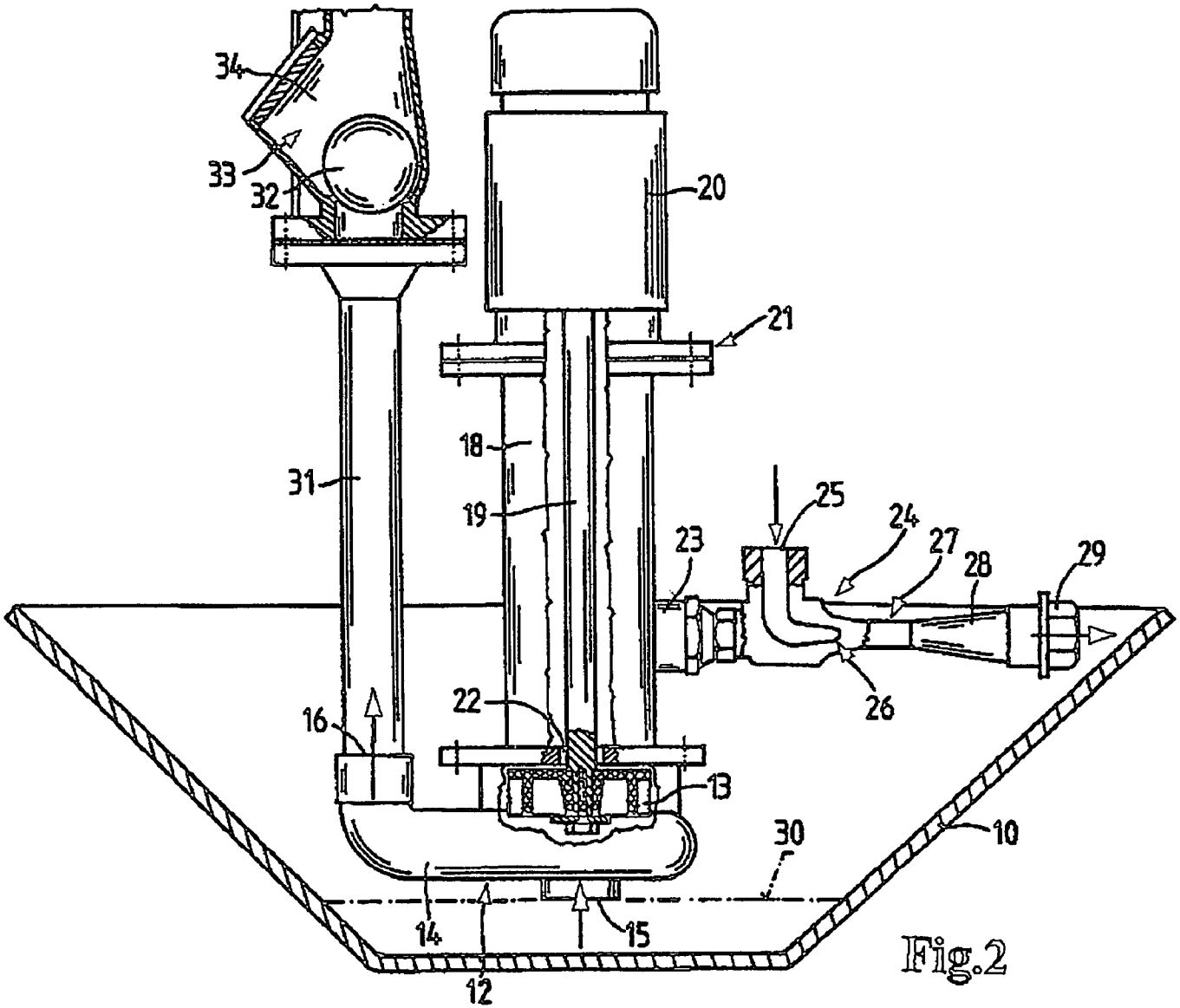
FIG. 2 is a representation of a device according to the invention for conveying a liquid which is present only at a low liquid level.

FIG. 2 likewise shows a schematic representation of a device for transporting liquids. However, this device is constructed in accordance with the present invention. Parts corresponding to those in the device shown in FIG. 1 are identified by like reference numerals. The impeller 13 is situated in the vicinity of the mounting flange, i.e., the connection to the pump housing, thereby producing a small bearing gap 22 between the housing 18 and the drive shaft 19.

The housing 18 is equipped with a connecting flange 23 or connector for connecting the shaft housing 18 to a source of negative pressure. For example, an ejector 24 having a liquid inlet 25 and an ejector nozzle 26 may be connected to the connecting flange 23. The ejector nozzle 26 is situated directly upstream from a reduction 27 in the cross-section of the outlet pipe 28. The outlet pipe 28 is provided with a connector 29 on which a discharge pipe or discharge hose can be mounted.

The liquid for the ejector flows into the ejector under positive pressure and forms an ejector jet which generates a negative pressure in the housing 18. The negative pressure extends through the bearing gap 22 around the shaft into the pump housing 14, thereby drawing liquid into the pump housing 14 until the liquid reaches a level that is above the impeller 13. Thus, even for a liquid level 30 at the height of the intake opening 15 it is possible to evacuate the liquid.

In order to limit the volume that is under negative pressure, a riser pipe 31 connected to the liquid discharge opening 16 is provided with a non-return valve in the form of a ball 32. This ball 32 is situated in an enlarged cross-sectional region 33. As soon as the liquid ascends in the riser pipe 31, the ball 32 is displaced upward, i.e., into the dead space 34, and the liquid is able to flow out unimpeded.

The coolant lubricant liquid naturally contains production residues such as chips or cuttings from industrial machining processes. These residues may be easily transported using the illustrated pump 12. The negative pressure generated by the ejector is adjustable, for example by adjusting of the pressure of the supplied liquid. Depending on the layout, the pump 12 is capable of transporting a liquid volume of from 50 liters to 6,000 liters per minute.

In the generation of negative pressure, it is important that the negative pressure is required before or during start-up of the pump 12. Of course, the negative pressure could be shut off after the pump is started, but the negative pressure may be easily maintained throughout the entire operating lifetime of the pump 12.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A device for conveying a liquid, said device comprising:

a vertical pump comprising a pump housing with an inlet opening and a liquid discharge opening, a pump impeller rotatably mounted in said pump housing, an electric motor for driving the pump impeller, and a drive shaft connected between the motor and the pump impeller, wherein the drive shaft is enclosed by a shaft housing that is provided with a connector which is connected to a source of negative pressure, and above the pump impeller at least one gap in the shaft housing is provided for the drive shaft, and wherein, at least at the start of pumping, a negative pressure is generated in the shaft housing, said negative pressure extending through said gap into the pump housing to draw liquid through the inlet opening into the pump housing, wherein said source of negative pressure comprises an ejector through which purified cooling lubricant liquid is fed from a source independent of said vertical pump to generate the negative pressure.

2. A device according to claim 1, wherein the liquid discharge opening is connected to a liquid pipe, and a non-return valve is located in said liquid pipe.

3. A device according to claim 1, wherein the liquid pumped through the ejector to generate the negative pressure is introduced into the liquid to be conveyed by the device.

4. A device according to claim 1, wherein the negative pressure ranges from 0.05 bar to 0.3 bar.

5. A device according to claim 1, wherein the negative pressure is adjustable.

6. A device according to claim 1, wherein a mounting flange is provided on the pump via which the pump can be mounted in a liquid container.

7. A device according to claim 1, wherein the electric motor is connected to the drive shaft housing via a connecting flange.

8. A device according to claim 1, wherein the intake opening of said pump is connected to a source of used coolant/lubricant containing production residues.

9. A device according to claim 1, wherein the negative pressure is generated in the shaft housing before start-up of the pump.

* * * * *